US005174118A

United States Patent [19]

Polsky

[11] Patent Number: 5,174,118

[45] Date of Patent: Dec. 29, 1992

[54] FLUID PRESSURE-RESPONSIVE UNIT

[76] Inventor: Max Polsky, 5556 Boarden Ave., Côte St-Luc, Québec, Canada, H4V 2T6

[21] Appl. No.: 802,968

[22] Filed: Dec. 6, 1991

[30] Foreign Application Priority Data

Dec. 12, 1990 [CA] Canada ..... 2032108

[51] Int. Cl.[5] ..... F03C 5/00

[52] U.S. Cl. ..... 60/530; 60/531; 52/86; 52/35

[58] Field of Search ..... 52/86, 34, 35, 41, 44; 60/507, 508, 530, 531

[56] References Cited

U.S. PATENT DOCUMENTS

| | | | |
|---|---|---|---|
| 1,886,803 | 11/1932 | Giesler | 92/34 |
| 1,928,368 | 9/1933 | Coffey | 92/43 |
| 2,129,638 | 9/1938 | Baker | 60/531 |
| 2,372,393 | 3/1945 | Ray | 91/459 |
| 2,934,956 | 5/1960 | Holzboog | 60/530 |
| 2,942,838 | 6/1960 | Peters | 92/41 |
| 3,211,184 | 10/1965 | Greer | 138/30 |
| 3,295,458 | 1/1967 | Steffes | 92/99 |
| 3,485,258 | 12/1969 | Greene | 137/112 |
| 3,550,162 | 12/1970 | Huffman et al. | 60/531 |
| 4,080,107 | 3/1978 | Ferrentino | 92/44 X |
| 4,186,558 | 2/1980 | Kuo | 60/530 X |
| 4,231,720 | 11/1980 | Konig | 60/531 X |
| 4,648,246 | 3/1987 | Huber | 60/530 |
| 4,833,973 | 5/1989 | Wang | 91/468 |

*Primary Examiner*—Edward K. Look
*Assistant Examiner*—Hoang Nguyen
*Attorney, Agent, or Firm*—Nikaido, Marmelstein, Murray & Oram

[57] ABSTRACT

The fluid pressure-responsive unit of the invention defines a chamber formed of a base plate, a top plate and a heat-exchange bellows sidewall joining the two plates. Relative movement of the plates is controlled by springs and guiding cylinders within the chamber. The base plate incorporates a fluid intake aperture for admitting fluid into the chamber and the latter further contains an overflow assembly including a looped resilient pipe of which one end is connected to the top plate so as to receive fluid overflowing from the chamber. The other end can be connected to another pipe introduced into the chamber by the intake aperture to lead fluid out of the chamber.

14 Claims, 1 Drawing Sheet

FLUID PRESSURE-RESPONSIVE UNIT

BACKGROUND OF THE INVENTION

1. Field of the Invention

The present invention relates to a fluid pressure-responsive unit that can be used, for example, on a fluid closed circuit wherein fluid can be subjected to expansion or compression.

2. Description of the Prior Art

A prior art search made by the present applicant has revealed U.S. Pat. No. 4,833,973 of May 30, 1989 to WANG, which patent relates to a fluid pressure-actuated assembly including a resilient cup-shaped housing made of rubber, of which the open end has a radial outer flange fluid-tightly fixed to a base plate having a conduit for leading a fluid in and out of the housing. A spring assembly surrounds the housing and allows it to expand against its bias when the fluid pressure increases, and allows it to return to retracted position when the pressure is reduced. As an example, the assembly is used in conjunction with the hydraulic circuit of a height-adjustable chair. The housing has a single conduit through which the oil flows in and out depending on whether the oil pressure increases or decreases. One drawback with the present assembly resides in the fact that no overflow means is provided for eliminating gas from the chamber when the fluid used is a liquid. Also, the rubber casing is not appropriate with any fluid, because its characteristics deteriorate with time in contact with certain fluids.

The following other patents found during the search have revealed the following US patents which are considered of little pertinency with respect to the present invention:

U.S. Pat. No. 1,886,803, J. V. GIESLER, 1932
U.S. Pat. No. 1,928,368, G. E. COFFEY, 1933
U.S. Pat. No. 3,211,184, E. M. GREER, 1965
U.S. Pat. No. 3,295,458, A. P. G. STEFFES, 1967
U.S. Pat. No. 3,485,258, G. B. GREENE, 1969

Also, one drawback with the expansion chambers known in the art reside in the fact that they are subjected to leaking.

An object of the present invention is to provide a fluid pressure-responsive unit that prevents the leaking of fluids and that can be used for cooling the fluid.

SUMMARY OF THE INVENTION

According to the invention, there is provided a fluid pressure-responsive unit comprising:

a base plate and a top plate;

a bellows sidewall made of heat-exchange material and fluid tightly connected, at its ends, respectively to said base and top plates, said bellows sidewall defining, with said plates, a fluid chamber;

resilient return means interconnecting said plates for allowing them to move relative to one another, whereby said chamber may expand and contract responsive to fluid pressure fluctuations;

a fluid intake aperture formed in said base plate for admitting fluid into said chamber;

a fluid overflow conduit in said chamber, said conduit having a first end provided with a connecting means for fixing said first end inside said chamber, said first end being fixed in a predetermined position for receiving fluid overflowing from said chamber, and a second end provided with a connecting means by which said second end can be connected to another conduit introduced into said chamber by means of said fluid intake aperture for leading overflowing fluid out of said chamber; and guiding and stopping means interconnecting said plates for guiding them when they move relative to one another, and for limiting expansion of said chamber when the distance between said plates reaches a predetermined length.

Preferably, the bellows sidewall is made of stainless steel.

A description now follows of a preferred embodiment of the invention, having reference to the appended drawings.

DESCRIPTION OF THE PREFERRED EMBODIMENT

Figure 1:
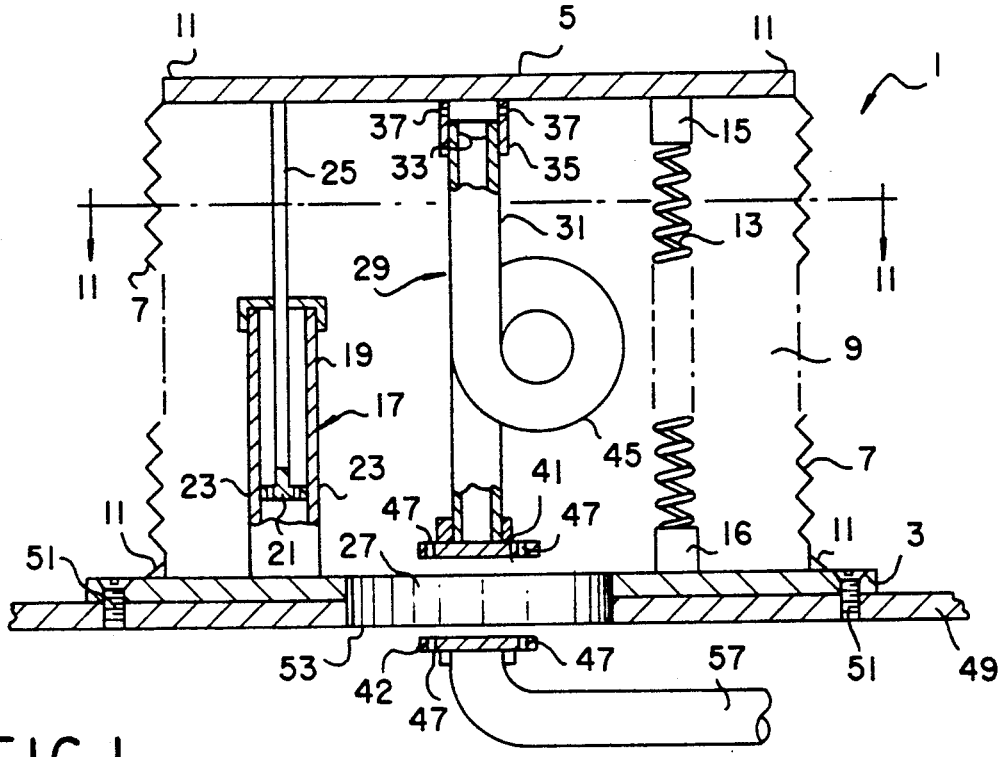
FIG. 1 is a cross-section view of the fluid pressure-responsive unit made according to the invention and shown on FIG. 2, taken along line I—I.

The illustrated unit 1, made according to the invention, generally comprises a stationary circular base plate 3, a movable circular top plate 5 and a cylindrical sidewall 7 in the form of a thin-walled extensible bellows joining the two plates to define a fluid chamber 9.

The unit is used as an expansion and cooling chamber, the plates 3, 5, are made of metal, the bellows sidewall 7 is made of heat-exchange material, such as stainless steel, and is fluid-tightly connected to the plates by welds 11, for instance.

Figure 2:
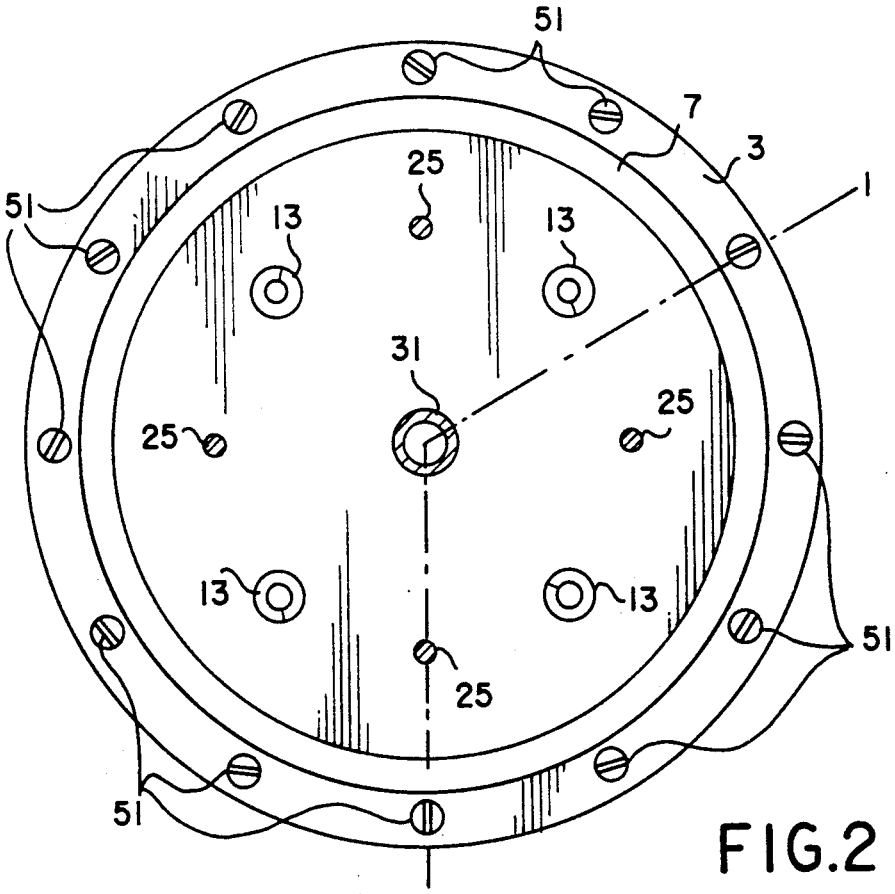
FIG. 2 is a transverse cross-section taken along line II—II of FIG. 1.

Four coil springs 13, evenly spaced around the plates as shown in FIG. 2, are interconnect through appropriate brackets 15, 16 fast with the plates. They act as resilient return means for the plates and bias them toward a retracted neutral position. When the fluid in the chamber expands, under positive pressure, they act as tension springs; when a partial vacuum builds up, they act as compression springs. They thus allow the plates 3, 5, to move relative to one another when the chamber 9 is expanding or contracting in response to fluid pressure fluctuations.

The plates 3, 5, are guided in their relative displacement toward and away from one another by four cylinder assemblies 17 evenly spaced and set between successive springs 13. Each assembly includes a cylinder 19 fixed to the base plate 3, a piston 21 having appropriate holes 23, and a piston rod 25 of which the free end is secured to the top plate 5. The ends of the cylinder 19 act as limit stops for the movable plate 5. The springs 13 and cylinder assemblies 17 are mounted within the chamber 9 for protection against rust.

Fluid is admitted into the chamber 9 by an intake aperture 27 formed through the base plate 3. A fluid overflow outlet from the chamber 9 is provided by an overflow conduit 29 which comprises a resilient annular corrugated pipe 31 made of stainless steel, having a threaded nozzle 33 at one end solidly fixed to the free open end of a sleeve connector 35 welded to and projecting down from the top plate 5. The nozzle 33 is spaced from the plate 5 and the inlet apertures 37 are formed in the sleeve connector 35 to lead fluid into the pipe 31. The conduit 29 further comprises a radial flange 41, at the other end of the pipe 31, which can be connected to a return pipe 57 also provided with a radial flange 42. As noted, the pipe 31 is bent into a loop 45 between its ends to allow it to follow the movement of the top plate 5 relative to the base plate 3.

The upper threaded nozzle 33 is screwed onto the free end of the connector 35. The connector 35 is provided with threads around its bore and the periphery of the nozzle 33 force fitted around them. The lower flange 41 of the pipe 31 may be provided with threaded holes 47 by which it can be screwed to the flange 42 also provided with threaded holes 47.

The base plate 3 is fastened to the wall 49 which is part of the oil closed circuit. Fastening may be by means of screws 51. This wall 49 also comprises an aperture 53 aligned with the intake aperture 27 of the base plate.

As the oil in the circuit heats up, it expands in the chamber 9 forcing the top plate 5 away from the base plate 3. As the oil cools, it contracts and the top plate 5 is forced back toward the base plate 3 by the springs 13.

The return overflow pipe 57 is provided to carry the oil away from the expansion chamber 9 when it is full. This pipe 57 serves the purpose allowing any air entrapped in the system to be expelled, when the other extremity of the pipe 57 is opened. The pressure of the incoming liquid during the filling of the system will displace any air through the overflow pipe 57. This function is necessary to purge the system. Once the system is full of oil, the pipe 57 is closed and the system is closed. This purging is required so that no air remains, which could cause gassing of the oil.

Although the present invention has been explained hereinabove by way of a preferred embodiment thereof, it should be pointed out that any modifications to this preferred embodiment, within the scope of the appended claims is not deemed to change or alter the nature and scope of the present invention.

The embodiments of the invention in which an exclusive property or privilege is claimed are defined as follows:

1. A fluid pressure-responsive unit comprising:

a base plate;

a top plate;

a bellows sidewall made of heat-exchanging material and fluid tightly connected at base and top ends, respectively to said base and top plates, said base plate, top plate and bellows sidewall defining a fluid chamber;

resilient return means interconnecting said plates within the fluid chamber so as to allow movement of said plates relative to one another, whereby the fluid chamber may expand and contract responsive to fluid pressure fluctuations;

fluid intake aperture formed in said base plate for admitting fluid into the fluid chamber, said aperture being formed so as to allow operative connection of the unit to a return overflow conduit;

a fluid overflow conduit fixedly located in the fluid chamber, said conduit having a first end provided with a first connecting means for fixing the first end inside the fluid chamber, the first end being fixed in a predetermined position for receiving fluid overflowing from the fluid chamber, and said conduit further having a second end provided with a second connecting means for connecting the second end to the return overflow conduit operatively connected to the fluid chamber so as to lead overflowing fluid out of the fluid chamber; and guiding and stopping means located in the fluid chamber and interconnecting said plates, for guiding the movement of said plates relative to one another, and for limiting expansion of the fluid chamber when a distance between said plates reaches a predetermined length.

2. A unit as defined in claim 1, wherein said bellows sidewall material is stainless steel.

3. A unit as defined in claim 2, wherein said plates are circular and said bellows sidewall is cylindrical, and said guiding and stopping means incorporates at least three cylinder assemblies mounted within the fluid chamber and equally disposed around a central axis of the fluid chamber, each of the cylinder assemblies including a cylinder fixed to one of said plates, a piston slidable in the cylinder to be guided by the cylinder and a piston rod fixed to the other of said plates.

4. A unit as defined in claim 3, wherein said return means incorporates at least three coil springs mounted within the fluid chamber and fixed at their ends respectively to said top and base plates, the springs being equally disposed around the central axis of the fluid chamber.

5. A unit as defined in claim 1, further comprising:

a connector ring projecting down from said top plate within the fluid chamber and having an open end located at a predetermined distance from said top plate; and wherein said conduit is a resilient annular corrugated pipe made of metal, and the first connecting means of the first end of said conduit incorporates a radial flange solidly fixed to said connector ring at the open end thereof, the radial flange having at least one aperture for allowing fluid to flow from the fluid chamber into said connector ring and then into said conduit.

6. A unit as defined in claim 5, wherein the metal of said conduit is stainless steel.

7. A unit as defined in claim 5, wherein said conduit is a resilient pipe with a loop between the first and second ends thereof.

8. A fluid pressure-responsive unit comprising:

a fluid chamber having a base plate, a top plate, and a bellows sidewall, the bellows sidewall being made of heat-exchange material and fluid tightly connected at base and top ends, respective to the base and top plates;

resilient return means interconnecting the plates within said fluid chamber so as to allow movement of the plates relative to one another, whereby said fluid chamber may expand and contact responsive to fluid pressure fluctuations;

a fluid intake aperture formed in the base plate for admitting fluid into said fluid chamber, said aperture being formed so as to allow operative connection of the unit to a return overflow conduit;

a fluid overflow conduit fixedly located in said fluid chamber, said conduit having a first end provided with a first connecting means for fixing the first end inside said fluid chamber, the first end being fixed in a predetermined position for receiving fluid overflowing from said fluid chamber, and said conduit further having a second end provided with a second connecting means for connecting the second end to the return over flow conduit operatively connected to said fluid chamber so as to least overflowing fluid out of said fluid chamber; and guiding and stopping means located in said fluid chamber and interconnecting the plates, for guiding the movement of the plates relative to one another, and for limiting expansion of said fluid chamber when a distance between the plates reaches a predetermined length.

9. A unit as defined in claim 8, wherein said bellows sidewall material is stainless steel.

10. A unit as defined in claim 9, wherein the plates are circular and said bellows sidewall is cylindrical, and said guiding and stopping means incorporates at least three cylinder assemblies mounted within said fluid chamber and equally disposed around a central axis of said fluid chamber, each of the cylinder assemblies including a cylinder fixed to one of the plates, a position slidable in the cylinder to be guided by the cylinder and a position rod fixed to the other of the plates.

11. A unit as defined in claim 10, wherein said return means incorporates at least three coil springs mounted within said fluid chamber and fixed at their ends respectively to said top and base plates, the springs being equally disposed around the central axis of said fluid chamber.

12. A unit as defined in claim 9, further comprising:

a connector ring projecting down from the top plate within said fluid chamber and having an open end located at a predetermined distance from the top plate; and wherein said conduit is a resilient annular corrugated pipe made of metal, and the first connecting means of the first end of said conduit incorporates a radial flange solidly fixed to said connector ring at the open end thereof, the radial flange having at least one aperture for allowing fluid to flow from said fluid chamber into said connector ring and then into said conduit.

13. A unit as defined in claim 12, wherein the metal of said conduit is stainless steel.

14. A unit as defined in claim 12, wherein said conduit is a resilient pipe with a loop between the first and second ends thereof.

* * * * *